US011140953B2

(12) United States Patent
Monbouquette et al.

(10) Patent No.: US 11,140,953 B2
(45) Date of Patent: Oct. 12, 2021

(54) CONVERTIBLE PENDANT AND EARRINGS

(71) Applicant: Monbouquette Jewelry, LLC, Santa Monica, CA (US)

(72) Inventors: Jenny Monbouquette, Santa Monica, CA (US); Lily Monbouquette, San Francisco, CA (US)

(73) Assignee: Monbouquette Jewelry, LLC, Santa Monica, CA (US)

( * ) Notice: Subject to any disclaimer, the term of this patent is extended or adjusted under 35 U.S.C. 154(b) by 45 days.

(21) Appl. No.: 16/731,637

(22) Filed: Dec. 31, 2019

(65) Prior Publication Data

US 2020/0214405 A1 Jul. 9, 2020

Related U.S. Application Data

(60) Provisional application No. 62/789,803, filed on Jan. 8, 2019.

(51) Int. Cl.
*A44C 15/00* (2006.01)
*A44C 25/00* (2006.01)

(52) U.S. Cl.
CPC ..... *A44C 15/0055* (2013.01); *A44C 25/001* (2013.01); *A44D 2203/00* (2013.01)

(58) Field of Classification Search
CPC . A44C 15/0055; A44C 25/001; A44C 25/002; A44C 25/007; A44C 25/004; A44D 2203/00
See application file for complete search history.

(56) References Cited

U.S. PATENT DOCUMENTS

| | | | | |
|---|---|---|---|---|
| 321,407 | A | 6/1885 | Washburn | |
| 1,562,168 | A * | 11/1925 | Harvey | A44C 25/004 63/19 |
| 2,731,812 | A * | 1/1956 | Sullivan | A44C 25/001 63/23 |
| 2,740,662 | A | 4/1956 | Scott | |
| 3,418,826 | A | 12/1968 | Wieshuber | |
| 3,533,247 | A | 10/1970 | Douglas | |
| 4,882,915 | A * | 11/1989 | Porcaro | A44C 25/004 63/19 |
| 6,718,797 | B2 | 4/2004 | Plumly | |
| 7,155,932 | B2 | 1/2007 | Renter | |
| D722,907 | S | 2/2015 | Miceli | |
| 2006/0174649 | A1 | 8/2006 | Azrielant | |
| 2009/0255122 | A1 | 10/2009 | Azrielant | |
| 2012/0240623 | A1 | 9/2012 | Morse | |

(Continued)

FOREIGN PATENT DOCUMENTS

| | | | |
|---|---|---|---|
| JP | 200655364 | A | 3/2006 |
| JP | 2008062028 | A | 3/2008 |

*Primary Examiner* — Jack W Lavinder
(74) *Attorney, Agent, or Firm* — Dergosits & Noah LLP

(57) ABSTRACT

A convertible pendant is disclosed in which a link connects to a first ornament. The pendant may have a first configuration in which a second ornament is housed within the first ornament and a second configuration in which the second ornament is deployed from the first ornament. In either configuration, the second ornament may be connected to the first ornament so that the second ornament is not easily lost. In a third configuration, the first and second ornaments may be detached from the link. The different configurations provide a pendant that may be adapted to suit different occasions.

19 Claims, 10 Drawing Sheets

(56) References Cited

U.S. PATENT DOCUMENTS

| | | | | |
|---|---|---|---|---|
| 2015/0143847 | A1* | 5/2015 | Weems | A44C 13/00 63/18 |
| 2015/0173471 | A1* | 6/2015 | Weems | A44C 25/004 63/19 |
| 2016/0007701 | A1* | 1/2016 | Silverstein | A44C 25/002 63/19 |
| 2016/0051015 | A1 | 2/2016 | Powers | |

* cited by examiner

CONVERTIBLE PENDANT AND EARRINGS

CROSS REFERENCE TO RELATED CASES

This application claims priority to U.S. Provisional Patent Application No. 62/789,803, entitled "CONVERTIBLE EARRINGS," filed Jan. 8, 2019, which is incorporated in its entirety.

TECHNICAL FIELD

The claimed subject matter relates generally to the field of ornamental jewelry and, more particularly, to earrings that are convertible from a first design to a second design.

BACKGROUND

The use of earrings to adorn the body has long been known. Numerous styles of earrings exist to suit one's taste, budget, and sense of fashion. Earrings vary greatly in their individual appearance and range from a simple single stud design to elaborate designs. Conventional earrings typically comprise a single fixed design. This results in wearers needing to own a number of earrings for various occasions.

It would be advantageous therefore to provide an earring that is convertible from one design type to another and therefore usable for multiple types of occasions. An earring that converted from a relatively simple design suitable for daytime wear, into a more elaborate design, more suitable for evening wear, would be of substantial benefit, as such an earring would serve to increase the variety of a wearer's jewelry wardrobe.

BRIEF SUMMARY

An embodiment meets a long-felt need in the art by providing a pendant for, e.g., an earring design necklace where the pendant is convertible from a first, stowed position featuring a relatively simple design having principally a single ornamental element, to a second, deployed, position featuring a more elaborate design and having multiple ornamental elements. In the embodiment, the pendant is convertible without the need to remove or replace any components of the pendant. In the embodiment, the pendant may be permanently attached to a link, such as a chain, ring, hoop, or device such as hooks, posts with a backing, clamps (magnetic or otherwise), and clip-on device for attaching an earring such as a stud. In an embodiment, the pendant may be removably attached to the link, thereby allowing the link, e.g., a chain, ring, or hoop, to be worn independently, if desired.

In an embodiment, the convertible earring designs may be in the form of a geometric shape, such as a ball, wherein the shape, e.g., a ball, comprises two halves that are magnetically coupled and may contain additional features within a cavity formed by the two halves. The earrings may be worn with the ball either closed or open. When the shape is opened, the additional ornamental features dangle from the interior of the shape. These additional features convert the earrings from a relatively simple shape to a more complex arrangement featuring multiple ornamental elements. The two halves may then be re-coupled to re-form the initial shape.

In an embodiment, the shape is hinged and when opened, at least one ornamental element is released to dangle below the shape. The at least one ornamental element may be one or more of gemstones, pearls, ornamental pieces of metal work, or like ornamental items. In the embodiment, the at least one ornamental element may be another metallic ball of smaller size.

In an embodiment, the shape comprises magnetically coupled upper and lower halves which may be separated by being pulled apart. The upper and lower halves may be interconnected, e.g., by links of chain, wire, or cord, which attach to at least one ornamental element that is suspended between the upper and lower halves of the shape. When the bottom half of the shape is separated (or pulled) from the upper half, the lower half dangles from the upper half with the at least one ornamental element suspended therebetween. The at least one ornamental element may be one or a combination of gemstones, pearls, ornamental pieces of metal work, or like ornamental items.

In an embodiment, the link may include a ring with a hinge that allows portions of the ring to pivot between open and closed positions. The ring portions may be magnetically coupled in the closed position. The ring of the link may also include ornamental features such as metal work, gemstones and the like. In an embodiment, the link may be either permanently or removably attached to the remainder of the convertible earring.

In embodiments, the convertible earrings increase the variety of a wearer's jewelry investment by providing earrings which are suitable for multiple occasions. The earrings offer a user enhanced utility as they are suitable in their closed or stowed configurations, for example, for business wear, and are suitable in their open or deployed configurations, for example, as evening wear.

In embodiments, the earring may be attached to a part of the wearer other than an ear, e.g., the nose, or lip.

The above and other advantages of the convertible earring design will be described in more detail below.

BRIEF DESCRIPTION OF THE DRAWINGS

The embodiments are illustrated by way of example and not limitation in the figures of the accompanying drawings, in which like references indicate similar elements, and in which.

DETAILED DESCRIPTION

The embodiments will now be described more fully hereinafter with reference to the accompanying drawings, in which embodiments are shown. The convertible earring however, may be embodied in many different forms and should not be construed as being limited to the embodiments set forth herein. Rather these embodiments are provided so that this disclosure will be thorough and complete, and will fully convey the scope of the subject matter to those skilled in the art. Like numbers refer to like elements throughout.

In embodiments, the earring may be attached to a part of the wearer other than an ear, e.g., the nose, or lip. Thus, though "earring" is generally used to describe the embodiments, it should be understood that the embodiments described as "earrings" are not limited to being worn on the ear and that, as a result, the same embodiments should also be considered "rings" that the wearer may position as desired (as pendants on a necklace, or on a bracelet, etc.).

In FIGS. 1-5, an exemplary first embodiment of a convertible earring 10 is depicted.

Figure 1:
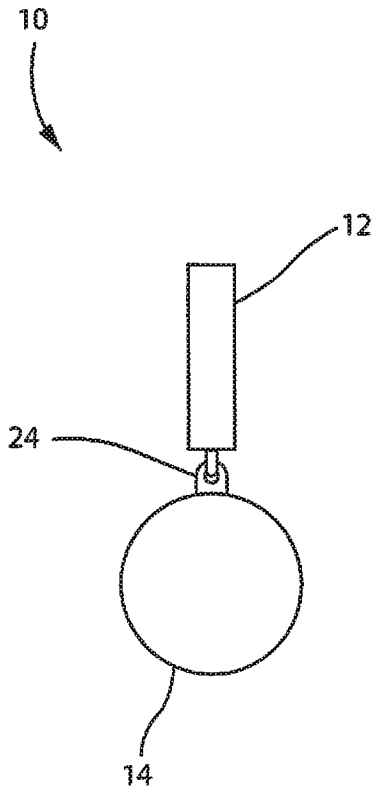
FIG. 1 is a front view of a first embodiment of a convertible pendant as part of a convertible earring.

FIG. 1 is a front view of the first embodiment of a convertible pendant 14 as part of a convertible earring 10. In FIG. 1, earring 10 includes a ring-shaped link 12 and pendant 14, which in this example is a spherical ball, coupled to ring-shaped link 12 with a link 24. While a pendant 14 is a sphere in this example, embodiments may use different shapes without departing from the subject matter of this application.

Figure 2:
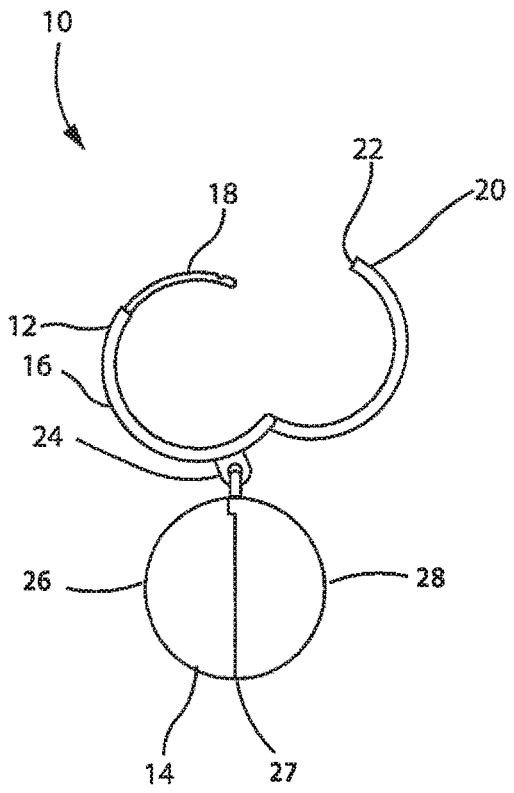
FIG. 2 is a side view of the first embodiment of a convertible earring, showing the link of the earring unlatched.

FIG. 2 is a side view of the first embodiment of the convertible earring 10, showing link 12 of the earring unlatched. Ring-shaped link 12 is configured to attach to a wearer's ear and comprises a thick ring portion 16, which may be inset with decorative elements such as gemstones, and a thin ring portion 18 which engages a (pierced) ear of a wearer. Link 12 also includes a hinged ring portion 20, which is pivotally connected (e.g., by a hinge) to the thick ring portion 16. Thin ring portion 18 extends from an end of the thick ring portion 16 and engages with a slot 22 (or hole) formed on (or into) an end of the hinged ring portion 20, to form a traditional prong and slot style hoop closure. In an embodiment, thin ring portion 18 and hinged ring portion 20 may be magnetized such that an end of the thin ring portion 18 magnetically couples with the end or slot 22 of hinged ring portion 20. Pendant 14 includes halves 26 and 28 coupled at a seam 27. Pendant 14 may be pivotally coupled to link 12 by means of link elements 24, which may include a tab attached to link 12 and a corresponding wire attached to pendant 14 and threaded through a hole within the tab.

Figure 3:
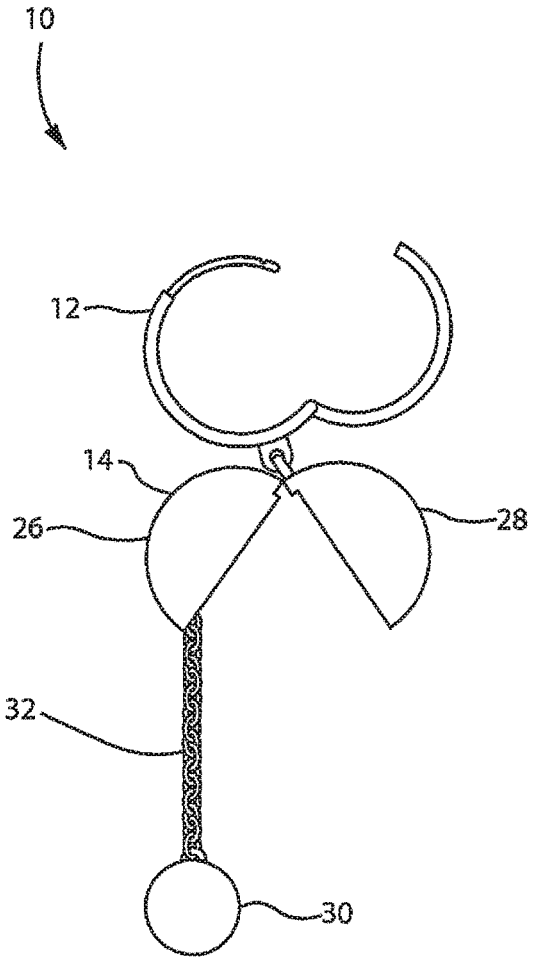
FIG. 3 is a side view of the first embodiment of a convertible earring with the shape open, showing an ornamental element dangling below.

FIG. 3 is a side view of the first embodiment of the convertible earring 10 with pendant 14 open, showing an ornamental element 30 dangling below. In FIG. 3, pendant 14 may include two pivotally connected halves 26 and 28, which may also be magnetically coupled. At least one ornamental element 30 may be disposed within a cavity of pendant 14. Each ornamental element 30 may be, e.g., a gemstone, a pearl, an ornamental piece of metal work, or like ornamental item, connected to pendant 14 by a connector 32. Ornamental element 30 may be concealed within the pendant 14 when pendant 14 is in a closed position. When pendant 14 is in an open position, ornamental element 30 may depend from, or dangle from, the pendant 14, as in FIG. 3, or FIG. 4, or FIG. 5.

Figure 4:
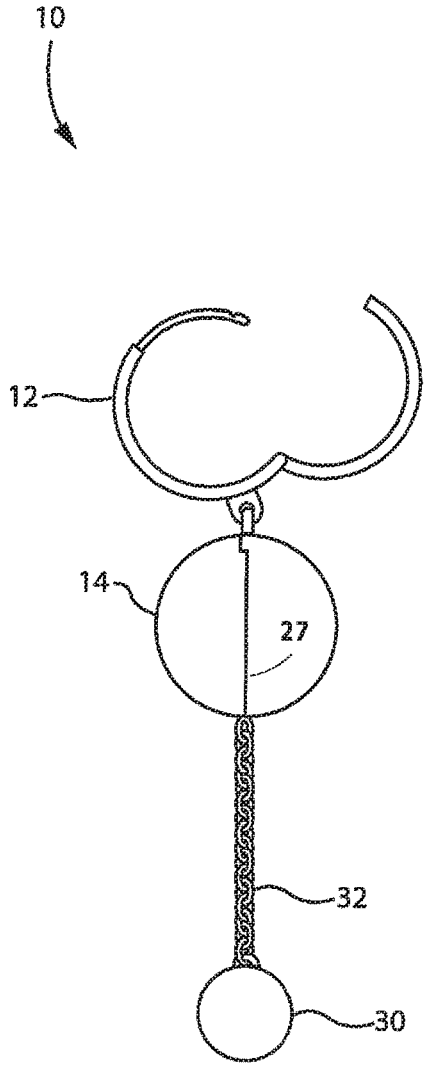
FIG. 4 is a side view of the first embodiment of a convertible earring with the shape closed, showing an ornamental element dangling below.
Figure 5:
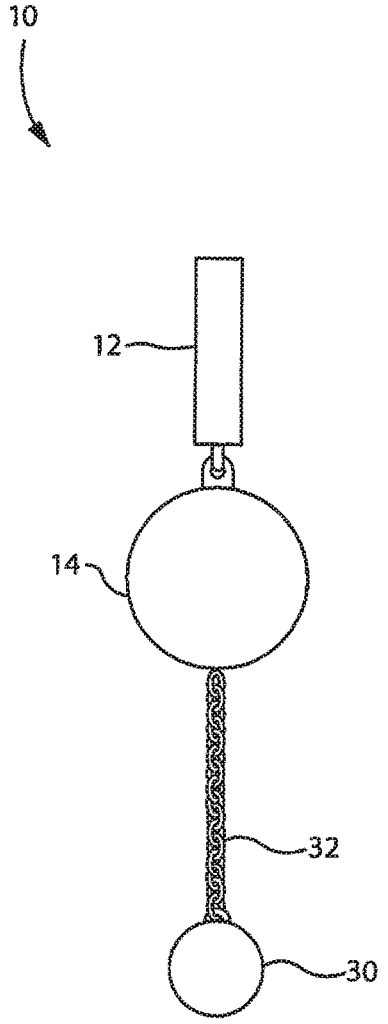
FIG. 5 is a front view of the first embodiment of a convertible earring with the shape closed, showing an ornamental element dangling below.

FIG. 4 is a side view of the first embodiment of convertible earring 10 with pendant 14 closed, showing ornamental element 30 dangling below. FIG. 5 is a front view of the first embodiment of convertible earring 10 with ball 30 closed, showing ornamental element 30 dangling below.

In the exemplary embodiment of the convertible earring 10 in FIGS. 1-5, ornamental element 30 may be a smaller spherical ball that dangles from the pendant 14 by means of a length of connector 32, which may be a chain. An end of connector 32 may be connected to the at least one ornamental element 30 and the other end may be connected within one of the halves 26 or 28. In an embodiment, connector 32 may be connected to a lip or exterior surface of one of halves 26 or 28. In an embodiment, a hole may be formed within seam 27, i.e., between halves 26 and 28, that admits connector 32 such that connector 32 may be connected to an exterior of one of halves 26 or 28 and ornamental element 30 may be contained within pendant 14 when halves 26 and 28 are coupled.

Referring now to FIGS. 1 and 2, as may be seen, when ornamental element 30 of the first embodiment of earring 10 is not deployed, earring 10 appears as a relatively simple design suitable for business wear and other occasions where a relatively simple earring design may be preferred. With reference to FIGS. 4 and 5, when ornamental element 30 is deployed (i.e., dangling) from the pendant 14 with the pendant 14 in the closed condition, the convertible earring 10 presents a more complex design which may be preferred by a wearer for evening wear.

In an embodiment, two or more ornamental elements 30 may be disposed within a cavity of pendant 14, each connected to pendant 14 by a connector 32.

In an embodiment, more than one connector 32 may be connected to each ornamental element 30.

In an embodiment, halves 26 and 28 may be configured to remain both open or closed with ornamental element 30 deployed, which results in halves 26 and 28 having different ornamental effects when in the open position compared to the closed position.

In an embodiment, a convertible pendant includes; a first ornament including a first part, a second part, and a cavity defined by the first and second parts; a connector; and a second ornament connected by the connector to the first ornament. In this embodiment, the first and second parts are separable providing access to the cavity; the cavity is dimensioned to accept the second ornament and at least part of the connector; and the pendant has a first configuration in which the second ornament is within the cavity and a second configuration in which the first part and second part are coupled and the second ornament is external to the cavity. In an embodiment, in the first configuration the connector is within the cavity. In an embodiment, a first surface of the first part or a first surface of the second part are incomplete such that the second ornament is partly visible in the first configuration. In an embodiment, the first ornament is one of: a sphere, a cube, a cylinder, a cone, or another solid geometric shape (not always going to be a solid geometric shape. Sometimes textured, pierced, or an organic shape . . . ); and the second ornament includes one of: a gemstone, a pearl, an ornamental pieces of metal work, or a solid geometric shape. In an embodiment, the pendant further includes a link releasably connected to the first ornament, where the link is configured to connect to a user such that the pendant has a third configuration in which the first ornament is disconnected from the link and the link may be connected to the user. In an embodiment, the connector is dimensioned such that in the second configuration the second ornament is adjacent to the first ornament. In an embodiment, the connector is one of: a chain, a cord, or a hinge. In an embodiment, the first part and the second part magnetically couple, the magnetic coupling being releasable. In an embodiment, a hinge connects the first part and the second part. And in an embodiment, a link configured to connect to a user is connected to the first part of the first ornament, and the connector is connected to the first part of the first ornament.

Figure 6:
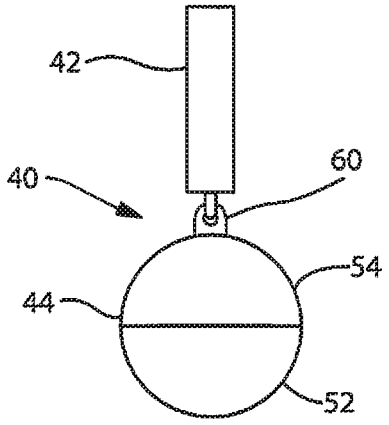
FIG. 6 is a front view of a second embodiment of a convertible pendant as part of a convertible earring.
Figure 7:
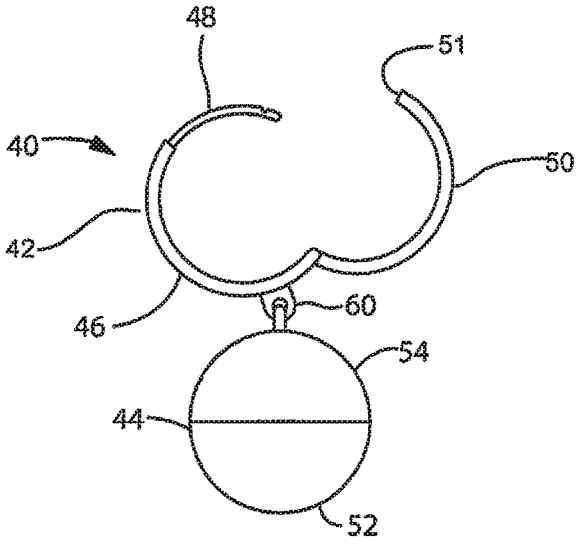
FIG. 7 is a side view of the second embodiment of a convertible earring, showing the link unlatched.
Figure 8:
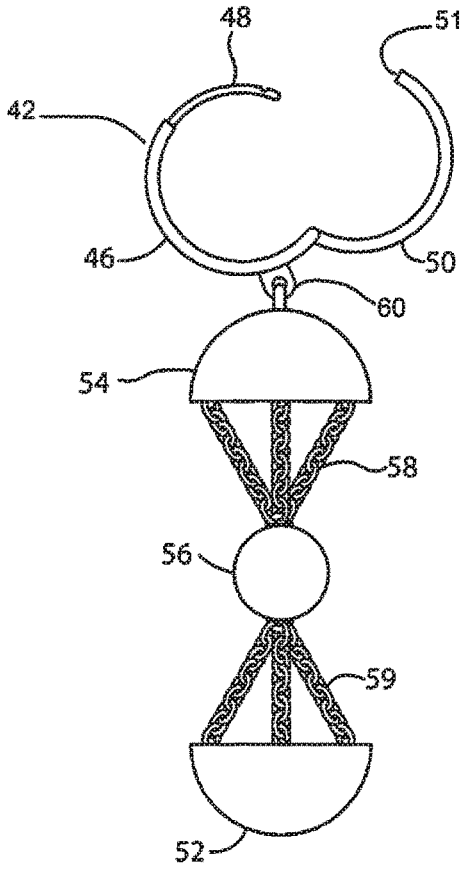
FIG. 8 is a side view of the second embodiment of a convertible earring, showing the upper and lower halves of the shape in their separated condition.

With reference to FIGS. 6-8, a second exemplary embodiment of a convertible pendant 44 as part of a convertible earring 40 is depicted. FIG. 6 is a front view of the second exemplary embodiment of convertible earring 40. Similar to the first embodiment of the earring 10, the second embodiment of the convertible earring 40 may include a ring-shaped link 42 and a pendant 44. While a pendant 44 is a sphere in this example, embodiments may use different shapes (e.g., including irregular and organic shapes) without departing from the subject matter of this application. Pendant 44 may be pivotally coupled to link 42 by means of link elements 60. Pendant 44 may be comprised of an upper half 54 and a lower half 52. In an embodiment, upper and lower halves 54 and 52 may be magnetically coupled.

FIG. 7 is a side view of the second exemplary embodiment of the convertible earring 40, showing link 42 unlatched. As shown in FIG. 7, ring-shaped link 42 may be configured to attach to a wearer's ear and include a thick ring portion 46, which may be inset with decorative elements such as gemstones, and a thin ring portion 48 which may engage a (pierced) ear of a wearer. Link 42 may also include a hinged ring portion 50 that may be pivotally connected to thick ring portion 46. Thin ring portion 48 may extend from an end of thick ring portion 46 and engage with a slot 51 (not shown in detail) or a hole formed on an end of hinged ring portion 50, to form a prong and slot style, traditional closure. In an embodiment, hinged ring portion 50 and 42 may be magnetized such that the end of portion 42 magnetically couples with the end of ring portion 50. Pendant 44 may be pivotally coupled to the link 42 by means of link elements 60, which are similar to link elements 24. In FIG. 7, disposed within the interior of pendant 44 is at least one ornamental element 56 (FIG. 8, obscured in FIG. 7 by coupled halves 52, 54), which, like element 30, may be a gemstone, a pearl, an ornamental piece of metal work, or like ornamental item.

FIG. 8 is a side view of the second embodiment of the convertible earring 40, showing upper and lower halves 52 and 54 of pendant 44 in their separated condition. In FIG. 8, ornamental element 56 is now visible, where in FIG. 7, ornamental element 56, connectors 58 and connectors 59 were concealed within pendant 44. With halves 52 and 54 in an open or separated position, ornamental element 56 may be suspended between upper and lower halves 54 and 52 with one or more connectors 58 connecting upper half 54 to ornamental ball 56 and one or more connectors 59 connecting ornamental ball 56 to lower half 52, as shown.

The at least one ornamental element 56 is suspended between the upper and lower halves 54 and 52, by at least one upper connecting element 58 and by at least one lower connecting element 59. The at least one upper connecting element connects to an upper portion of the at least one ornamental element 56 and to the interior of the upper half 54. The at least one lower connecting element 59 connects to a lower portion of the at least one ornamental element 56 and to the interior of the lower half 52.

In an embodiment, upper and lower connecting elements 58 and 59 may be chain or wire. In an embodiment, upper and lower connecting elements 58 and 59 may be other flexible materials.

Referring now to FIGS. 6-8, similar to the first exemplary embodiment of convertible earring 10, the second embodiment of convertible earring 40 may be convertible between a first position where pendant 44 is closed and earring 40 appears as a relatively simple design suitable for business wear and other occasions where a relatively simple earring design may be preferred. This relatively simple configuration is illustrated in FIG. 6 and FIG. 7. In a second configuration illustrated in FIG. 8, upper and lower ball halves 54 and 52 of pendant 44 are separated such lower half 52 depends or dangles below upper half 54, with ornamental element 56 disposed between upper half 54 and lower half 52. Ornamental element 56 may be connected with the upper and lower halves by upper and lower connecting links 58 and 59. In the second or deployed position, convertible earring 40 presents a more complex design which may be preferred by a wearer for evening wear.

In an embodiment in which halves 54 and 52 are coupled by magnetic force, a wearer may easily separate the two halves with her fingers without the need to take off the earrings.

Figure 9A:
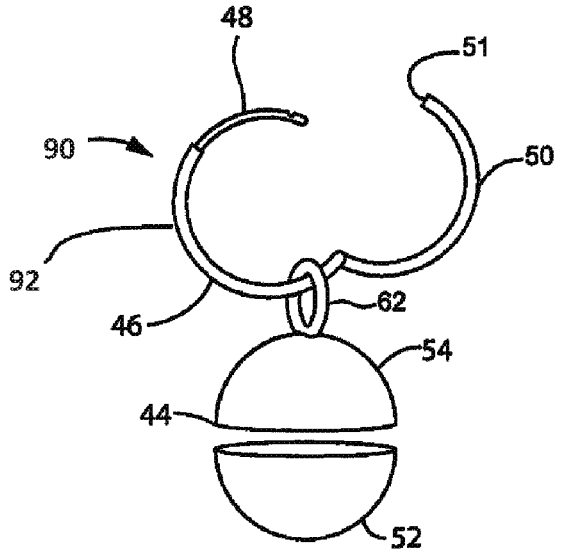
FIG. 9A depicts an embodiment of a convertible pendant as part of a convertible earring.

FIG. 9A depicts an embodiment of a convertible earring 90 with a link 92. Link 92 and a ring 62 may be employed equally with the embodiments of pendants discussed with respect to FIGS. 1-8. In FIG. 9, link 92 includes a hoop or ring 62, attached to the pendant 44. Link 92 has many elements in common with link 42 and like numbers indicate like elements. With Link 92, ring 62 is dimensioned so that it is slidable over the portions 46 and 48 of the link 92. With earring 90, a user may remove pendant 44 and wear link 92 alone. Thus, earring 90 provides users with a third earring configuration, i.e., the ring shape formed by halves 46 and 50, which may be worn without pendant 44.

In an embodiment, two or more ornamental elements 56 may be disposed within a cavity of pendant 44, each connected to pendant 44 by at least one upper connector 58 to upper half 54 and by at least one lower connector 59 to lower half 52.

In an embodiment, more than one upper connector 58 or lower connector 59 may be connected to each ornamental element 30.

Figure 9B:
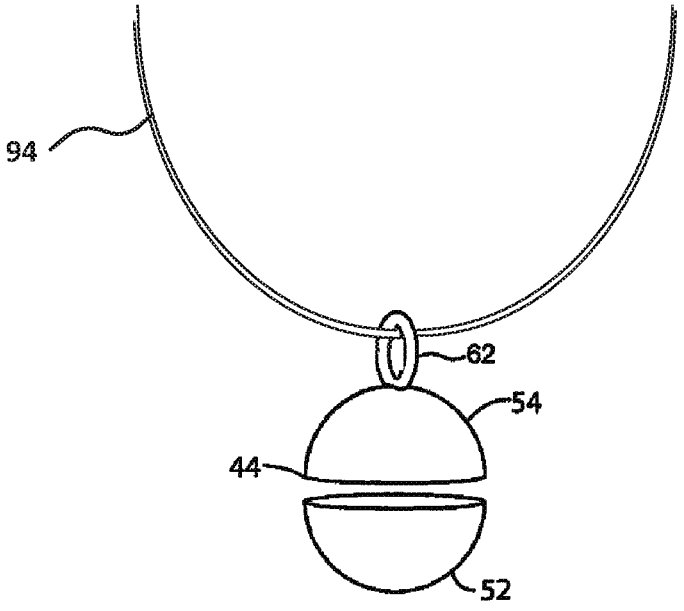
FIG. 9B depicts an embodiment of a convertible pendant as part of a necklace.

FIG. 9B depicts an embodiment of convertible pendant 44 with a necklace 94. Necklace 94 and ring 62 may be employed equally with the embodiments of pendant 14 discussed with respect to FIGS. 1-5. In FIG. 9B, necklace 94 is threaded through ring 62. With necklace 94, ring 62 is dimensioned so that it is slidable over a clasp (not shown) of necklace 94 so that a user may remove pendant 44 and wear necklace 94 alone. Thus, necklace 94 provides users with a third configuration, i.e., the necklace 94 alone. The inner elements 30 and 32 may also be deployed from inside pendant 44 and convert necklace 94 into an additional more "evening style" necklace.

Figure 10A:
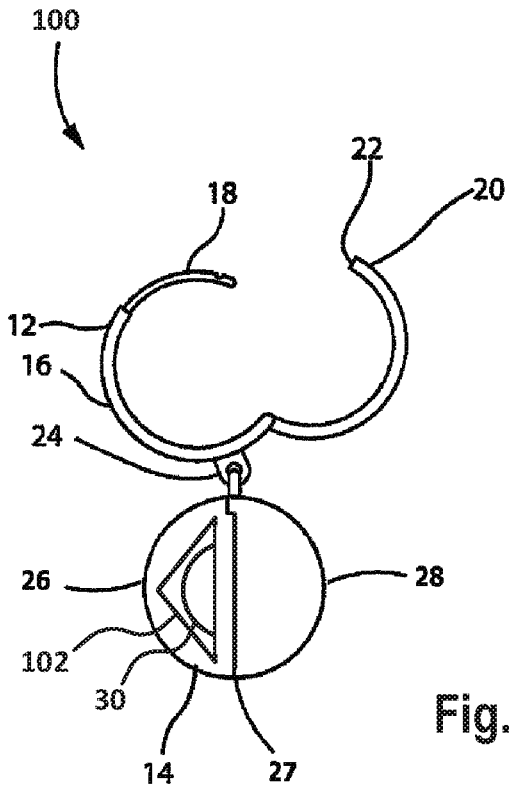
FIG. 10A depicts an embodiment of a convertible pendant as part of a convertible earring.
Figure 10B:
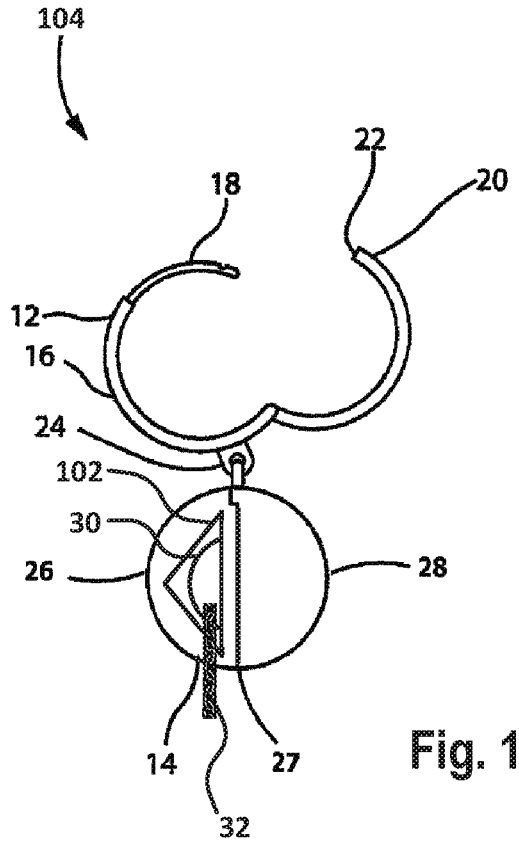
FIG. 10B depicts an embodiment of a convertible pendant as part of a convertible earring.

FIG. 10A depicts an embodiment of convertible pendant 14 in a convertible earring 100. FIG. 10B depicts an embodiment of convertible pendant 14 in a convertible earring 104. In FIG. 10A and FIG. 10B, earrings 100 and 104 include many of the features of earring 10 (e.g., FIG. 2). Like numbers refer to like elements between the figures.

In FIG. 10A, the surface of half 26 of pendant 14 is incomplete, having one or more windows 102 through which ornamental element 30 may be visible. In an embodiment, window 102 may be any arbitrary shape and the number of windows 102 may also vary arbitrarily. Similarly, half 28 may also have one or more windows 102. In the embodiments, connector 32 (not shown in FIG. 10A) may also be visible through window 102. In an embodiment, a window may be formed by the incomplete closure of seam 27. In embodiments, one or more similar windows may be formed in halves 52, 54 of pendant 44 of FIGS. 6-9.

In FIG. 10B, ornamental element 30 is oriented such that part of connector 32 extends through window 102 of half 26. Similarly, half 28 may have one or more windows 102 and connector 32 may extend through one of such windows. In embodiments, one or more similar windows may be formed in halves 52, 54 of FIGS. 6-9 and connectors 58, 59 or both may extend through one or more of such windows.

In the embodiments of FIGS. 1-10B, links 12, 42, and 92 are generally depicted as a hoop-shaped clasp. However, in embodiments, one of skill will understand that links 12, 42, and 92 may employ other types of links, such as hooks, posts with a backing, clamps (magnetic or otherwise), and clip-ons, to attach the remainder of the earring to the wearer. In embodiments, links 12, 42, and 92 may be used to attach the embodiment to the wearer at a location that is different from the ear, e.g., the nose, or lip.

In the embodiments, spherical balls 14, 44 may be replaced by other ornament shapes, e.g., cubes, textured and/or organic shapes, and ornaments 30, 56 and connectors 32, 58, 59 may be contained within cavities within the substituted shape.

In an embodiment, a convertible pendant may include: a first ornament including a first part, a second part, and a cavity defined by the first and second parts; a first connector; a second connector; and a second ornament connected by the first connector to the first part and connected by the second connector to the second part. In this embodiment: the first and second parts are separable providing access to the cavity; the cavity is dimensioned to accept the second ornament and at least part of the first connector and at least part of the second connector; and the pendant has a first configuration in which the second ornament is within the cavity and a second configuration in which the first part and second part are separated and at least part of the first connector, the second ornament, and at least part of the second connector are revealed. In an embodiment, in the first configuration the first connector, the second connector are within the cavity. In an embodiment, a first surface of the first part or a first surface of the second part are incomplete such that the second ornament is partly visible in the first configuration. In an embodiment, the first ornament is one of: a sphere, a cube, a cylinder, a cone, or another solid geometric shape or non-solid, organic shape; and the second ornament includes one of: a gemstone, a pearl, an ornamental pieces of metal work; or a solid geometric shape or a textured and/or organic shape. In an embodiment, the pendant further includes a link releasably connected to the first ornament, wherein: the link is configured to connect to a user such that the pendant has a third configuration in which the first ornament is disconnected from the link and the link may be connected to the user. In an embodiment, the first connector is dimensioned such that in the second configuration the first connector does not extend beyond the first part, or the second connector is dimensioned such that in the second configuration the second connector does not extend beyond the second part. In an embodiment, the connector is one of: a chain, a cord, or a hinge. In an embodiment, the first part and the second part magnetically couple, the magnetic coupling being releasable. In an embodiment, a hinge connects the first part and the second part. And in an embodiment, the link is connected to the first part of the first ornament, and the connector is connected to the first part of the first ornament.

While the embodiments have been described with regards to particular embodiments, it is recognized that additional variations may be devised without departing from the inventive concept.

The terminology used herein is for the purpose of describing particular embodiments only and is not intended to be limiting of the claimed subject matter. As used herein, the term "and/or" includes any and all combinations of one or more of the associated listed items. As used herein, the singular forms "a," "an," and "the" are intended to include the plural forms as well as the singular forms, unless the context clearly indicates otherwise. It will further be understood that the terms "comprises" and/or "comprising," when used in this specification, specify the presence of states features, steps, operations, elements, and/or components, but do not preclude the present or addition of one or more other features, steps, operations, elements, components, and/or groups thereof.

Unless otherwise defined, all terms (including technical and scientific terms) used herein have the same meaning as commonly understood by one having ordinary skill in the art to which the embodiments belong. It will further be understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the embodiments, it will be understood that a number of elements, techniques, and steps are disclosed. Each of these has individual benefit and each can also be used in conjunction with one or more, or in some cases all, of the other disclosed elements, or techniques. The specification and claims should be read with the understanding that such combinations are entirely within the scope of the embodiments and the claimed subject matter.

In the description above and throughout, numerous specific details are set forth in order to provide a thorough understanding of an embodiment of this disclosure. It will be evident, however, to one of ordinary skill in the art, that an embodiment may be practiced without these specific details. In other instances, well-known structures and devices are shown in block diagram form to facilitate explanation. The description of the preferred embodiments is not intended to limit the scope of the claims appended hereto. Further, in the methods disclosed herein, various steps are disclosed illustrating some of the functions of an embodiment. These steps are merely examples and are not meant to be limiting in any way. Other steps and functions may be contemplated without departing from this disclosure or the scope of an embodiment.

What is claimed is:

1. A convertible pendant comprising:

a first ornament including a first part, a second part, and a cavity defined by the first and second parts;

a connector; and a second ornament connected by the connector to the first ornament, wherein:

the first and second parts are separable providing access to the cavity;

the cavity is dimensioned to encompass the second ornament and at least part of the connector within the cavity; and the pendant has a first configuration in which the entirety of the second ornament is within the cavity and a second configuration in which the second ornament is external to the cavity, the second ornament remains connected to the first ornament, and the first and second parts are brought together.

2. The pendant of claim 1, wherein in the first configuration the connector is within the cavity.

3. The pendant of claim 1, wherein a first surface of the first part or a first surface of the second part are incomplete such that the second ornament is partly visible in the first configuration.

4. The pendant of claim 1, wherein the first ornament is one of: a sphere, a cube, a cylinder, a cone, or another solid geometric shape; and the second ornament includes one of: a gemstone, a pearl, an ornamental pieces of metal work, or a solid geometric shape.

5. The pendant of claim 1, further comprising a link releasably connected to the first ornament, wherein:

the link is configured to connect to a user such that the pendant has a third configuration in which the first ornament is disconnected from the link and the link may be connected to the user.

6. The pendant of claim 1, wherein the connector is dimensioned such that in the second configuration the second ornament is adjacent to the first ornament.

7. The pendant of claim 1, wherein the connector is one of: a chain, a cord, or a hinge.

8. The pendant of claim 1, wherein the first part and the second part magnetically couple, the magnetic coupling being releasable.

9. The pendant of claim 8, wherein a hinge connects the first part and the second part.

10. The pendant of claim 1, wherein a link configured to connect to a user is connected to the first part of the first ornament, and the connector is connected to the first part of the first ornament.

11. A pendant comprising:

a first ornament including a first part, a second part, and a cavity defined by the first and second parts;

a first connector;

a second connector; and a second ornament connected by the first connector to the first part and connected by the second connector to the second part, wherein:

the first and second parts are separable providing access to the cavity;

the cavity is dimensioned to encompass the second ornament and at least part of the first connector and at least part of the second connector within the cavity; and the pendant has a first configuration in which the entirety of the second ornament is within the cavity and the first and second parts are together and a second configuration in which the first part and second part are separated and at least part of the first connector, the second ornament, and at least part of the second connector are revealed.

12. The pendant of claim 11, wherein in the first configuration the first connector, the second connector are within the cavity.

13. The pendant of claim 11, wherein a first surface of the first part or a first surface of the second part are incomplete such that the second ornament is partly visible in the first configuration.

14. The pendant of claim 11, wherein the first ornament is one of: a sphere, a cube, a cylinder, a cone, or another solid geometric shape; and the second ornament includes one of: a gemstone, a pearl, an ornamental pieces of metal work; or a solid geometric shape.

15. The pendant of claim 11, further comprising a link releasably connected to the first ornament, wherein:

the link is configured to connect to a user such that the pendant has a third configuration in which the first ornament is disconnected from the link and the link may be connected to the user.

16. The pendant of claim 11, wherein the connector is one of: a chain, a cord, or a hinge.

17. The pendant of claim 11, wherein the first part and the second part magnetically couple, the magnetic coupling being releasable.

18. The pendant of claim 17, wherein a hinge connects the first part and the second part.

19. The pendant of claim 11, wherein a link configured to connect to a user is connected to the first part of the first ornament, and the connector is connected to the first part of the first ornament.

* * * * *